US008997768B1

(12) United States Patent
Bourne

(10) Patent No.: US 8,997,768 B1
(45) Date of Patent: Apr. 7, 2015

(54) RETRACTABLE CANOPY ASSEMBLY

(76) Inventor: Mike F. Bourne, Stoney Creek (CA)

( * ) Notice: Subject to any disclaimer, the term of this patent is extended or adjusted under 35 U.S.C. 154(b) by 274 days.

(21) Appl. No.: 13/456,408

(22) Filed: Apr. 26, 2012

(51) Int. Cl.
*E04H 15/04* (2006.01)
*E04H 15/08* (2006.01)
*E04F 10/06* (2006.01)

(52) U.S. Cl.
CPC ..... *E04F 10/06* (2013.01); *E04H 15/08* (2013.01); *E04H 15/04* (2013.01); *Y10S 135/903* (2013.01)

(58) Field of Classification Search
CPC ..... E04H 15/04; E04H 15/08; E04H 15/58; E04F 10/06; E04F 10/0611
USPC ..... 135/90, 94, 96, 117, 903
See application file for complete search history.

(56) References Cited

U.S. PATENT DOCUMENTS

| | | | | | |
|---|---|---|---|---|---|
| 370,259 | A | | 9/1887 | Horbaczewski | |
| 2,909,220 | A | | 10/1959 | Zimmerman | |
| 3,084,703 | A | * | 4/1963 | Lefebvre et al. | 135/91 |
| 3,327,724 | A | * | 6/1967 | Nielsen | 135/121 |
| 3,426,775 | A | * | 2/1969 | De Jonckheere et al. | 135/88.12 |
| D246,706 | S | | 12/1977 | McKee | |
| 4,102,353 | A | * | 7/1978 | Pugliese | 52/16 |
| 4,754,774 | A | * | 7/1988 | Leader | 135/88.14 |
| 5,170,811 | A | * | 12/1992 | Kirk et al. | 135/88.11 |
| 5,996,666 | A | | 12/1999 | Denina | |
| 6,619,726 | B2 | | 9/2003 | Jones | |
| 6,997,497 | B2 | | 2/2006 | Sagi et al. | |
| 7,086,684 | B2 | | 8/2006 | Glaser et al. | |
| 7,322,315 | B2 | * | 1/2008 | Brewer et al. | 119/498 |
| 7,520,290 | B2 | | 4/2009 | Dalbo | |
| 2010/0258252 | A1 | * | 10/2010 | Brutsaert | 160/48 |

FOREIGN PATENT DOCUMENTS

| | | | |
|---|---|---|---|
| DE | 19725892 | B4 * | 4/2006 |
| DE | 19726712 | B4 * | 10/2012 |

* cited by examiner

*Primary Examiner* — David R Dunn
*Assistant Examiner* — Danielle Jackson

(57) ABSTRACT

A retractable canopy assembly includes a recoiling member that has a first end, a second end and a perimeter wall extending between the first and second ends. A mount is attached to the recoiling member and is configured to engage a dwelling surface. A canopy has an attached end, a free end, a top surface, a bottom surface, a first lateral edge and a second lateral edge. The attached end extends through the canopy aperture and is attached to the spindle of the recoiling member. The recoiling member retracts the canopy into the recoiling member when the spindle rotates in the first direction. A pair of legs each is pivotally attached to the canopy adjacent to the free end. A pair of side panels each has a fixable end and a hanging end. Each of the first and second lateral edges has one of the fixable ends removably coupled thereto.

1 Claim, 3 Drawing Sheets

RETRACTABLE CANOPY ASSEMBLY

BACKGROUND OF THE DISCLOSURE

Field of the Disclosure

The disclosure relates to retractable canopy devices and more particularly pertains to a new retractable canopy device for temporarily expanding an area of a garage.

SUMMARY OF THE DISCLOSURE

An embodiment of the disclosure meets the needs presented above by generally comprising a recoiling member that has a first end, a second end and a perimeter wall extending between the first and second ends. The recoiling member is elongated along a longitudinal axis extending from the first end to the second end. The perimeter wall has a canopy aperture extending therethrough. The recoiling member includes a spindle rotatably mounted therein and a biasing member biasing a rotation of the spindle in a first direction. A mount is attached to the recoiling member and is configured to engage a dwelling surface. A canopy has an attached end, a free end, a top surface, a bottom surface, a first lateral edge and a second lateral edge. The attached end extends through the canopy aperture and is attached to the spindle of the recoiling member. The free end is retractably extendable outwardly from the perimeter wall. The recoiling member retracts the canopy into the recoiling member when the spindle rotates in the first direction. A pair of legs each is pivotally attached to the canopy adjacent to the free end. Each of the legs is telescopic. A pair of side panels each has a fixable end and a hanging end. Each of the first and second lateral edges has one of the fixable ends removably coupled thereto. Each of the side panels extends from the free end to the recoiling member. The canopy is configured to be retractably extended outwardly from the recoiling member. The legs may be telescopically extended downwardly into wells in a surface of a driveway.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
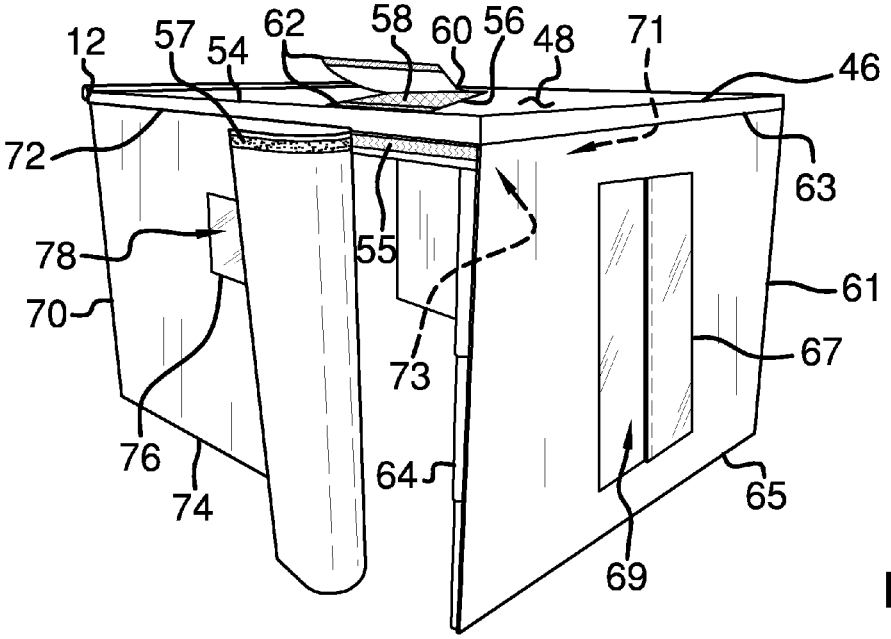
FIG. 1 is a front perspective view of a retractable canopy assembly according to an embodiment of the disclosure.
Figure 2:
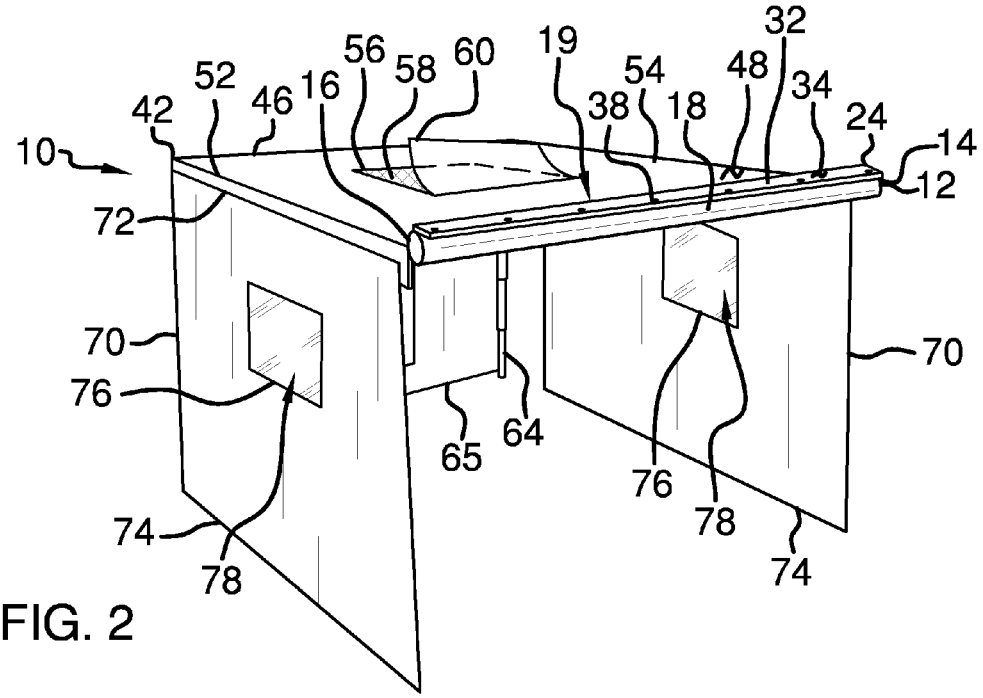
FIG. 2 is a back perspective view of an embodiment of the disclosure.
Figure 3:
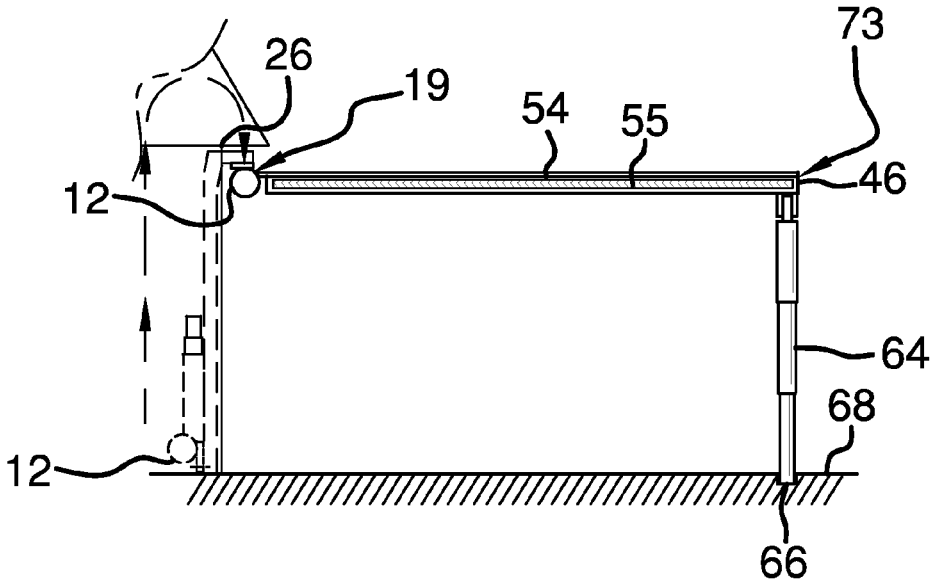
FIG. 3 is a right side view of an embodiment of the disclosure.
Figure 4:
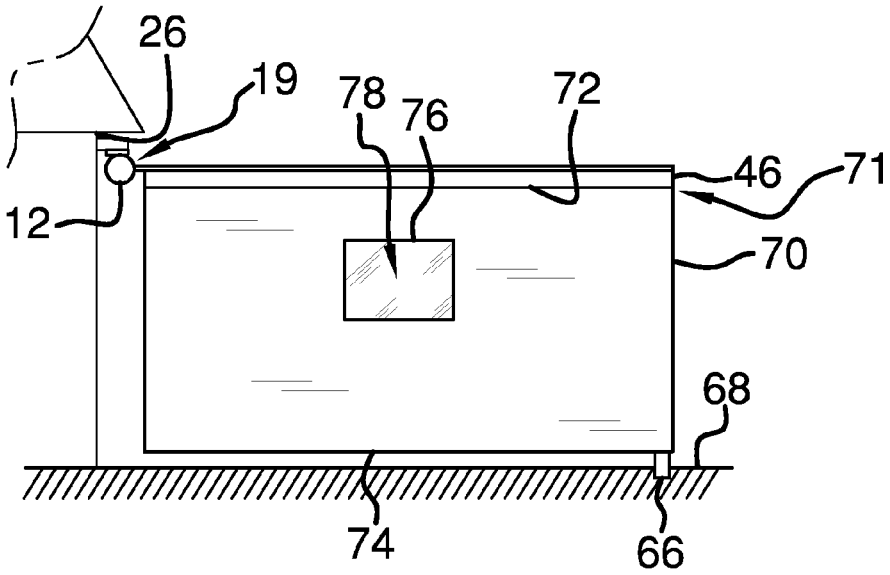
FIG. 4 is a right side in-use view of an embodiment of the disclosure.
Figure 5:
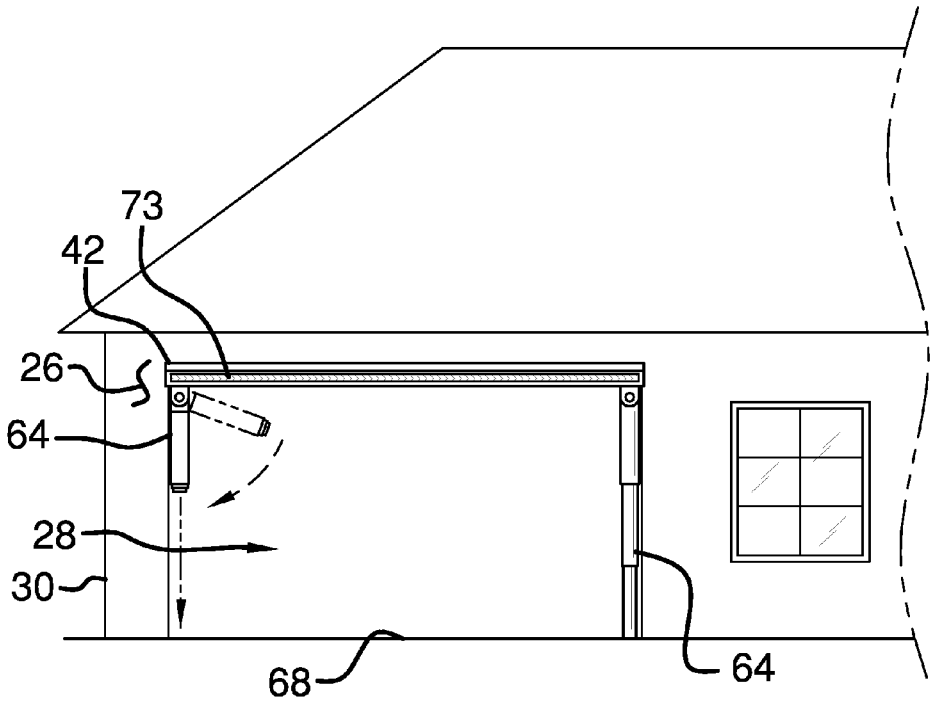
FIG. 5 is a front side in-use view of an embodiment of the disclosure.
Figure 6:
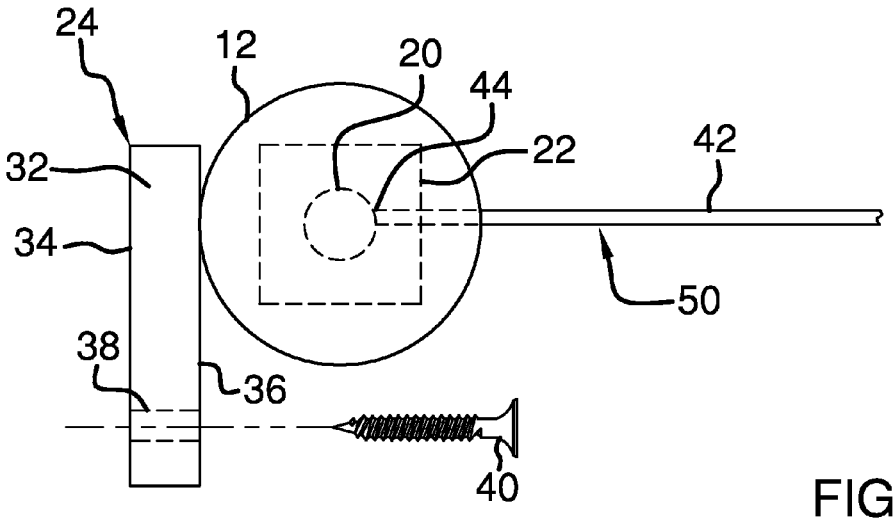
FIG. 6 is a right side phantom view of an embodiment of the disclosure.

With reference now to the drawings, and in particular to FIGS. 1 through 6 thereof, a new retractable canopy device embodying the principles and concepts of an embodiment of the disclosure and generally designated by the reference numeral 10 will be described.

As best illustrated in FIGS. 1 through 6, the retractable canopy assembly 10 generally comprises a recoiling member 12 that has a first end 14, a second end 16 and a perimeter wall 18 extending between the first 14 and second 16 ends. The recoiling member 12 is elongated along a longitudinal axis extending from the first end 14 to the second end 16. The perimeter wall 18 has a canopy aperture 19 extending therethrough. The recoiling member 12 includes a spindle 20 rotatably mounted therein and a biasing member 22 biasing a rotation of the spindle 20 in a first direction. The biasing member 22 may be a coil spring or other similar biasing member 22.

A mount 24 is attached to the recoiling member 12 and is configured to engage a dwelling surface 26 above an opening 28 in the dwelling surface 26. The opening 28 may be a garage door 30 or other similar opening 28. The mount 24 includes a plate 32 that has a front surface 34 and a back surface 36. The front surface 34 is attached to the perimeter wall 18 or an overhang of the opening 28 and the back surface 36 has a plurality of fastener apertures 38 extending therethrough. The mount 24 may engage the dwelling surface 26 with fasteners 40 such as screws or other similar fasteners 40. The fasteners 40 may pass through the fastener apertures 38 and engage the dwelling surface 26.

A canopy 42 has an attached end 44, a free end 46, a top surface 48, a bottom surface 50, a first lateral edge 52 and a second lateral edge 54. The attached end 44 extends through the canopy aperture 19 and is attached to the spindle 20. The free end 46 is retractably extendable outwardly from the perimeter wall 18. The spindle 20 rotates in a second direction when the free end 46 is retractably extended outwardly from the perimeter wall 18. The recoiling member 12 retracts the canopy 42 into the recoiling member 12 when the spindle 20 rotates in the first direction. The canopy 42 may be comprised of a flexible and water resistant material such as canvas or other similar material.

The canopy 42 has a vent aperture 56 extending therethrough. A net 58 is attached to the top surface 48 and covers the vent aperture 56. The net 58 comprises a mesh material. A flap 60 is attached to the top surface and is positionable over the vent aperture 56 and the net 58. A coupler 62 is attached to the flap 60 and the canopy 42 for releasably retaining the flap 60 in a closed position extending over the vent aperture 56. A pair of legs 64 each is pivotally attached to the canopy 42 adjacent to the free end 46. Each of the legs 64 is telescopic. Each of the legs 64 is telescopically extended downwardly from the canopy 42 into wells 66 in a surface of a driveway 68 so the canopy 42 is suspended above and parallel to the driveway 68. Each of the legs 64 may have an extendable length equal to a height of the opening 28 in the dwelling surface 26.

A pair of side panels 70 each has a fixable end 72 and a hanging end 74. Each of the first 52 and second 54 lateral edges has one of the fixable ends 72 removably coupled thereto. Each of the first 52 and second 54 lateral edges has a second coupler 55 attached thereto. Each of the fixable ends 72 has a third coupler 57 attached thereto. Each of the third couplers 57 engages corresponding ones of each of the second couplers 55. Each of the second 55 and third 57 couplers may comprise a hook and loop fastener. Each of the hanging ends 74 is directed downwardly towards the driveway 68 and each of the side panels 70 extends from the free end 46 to the recoiling member 12. Each of the side panels 70 has a viewing aperture 76 positioned therein. A pair of flexible windows 78 is provided and each of the side panels 70 has one of the flexible windows 78 attached thereto. Each of the viewing apertures 76 is covered with one of the flexible windows 78.

A front panel 61 has a top end 63 and a bottom end 65. The top end 63 is removably attached to and coextensive with the free end 46 and the bottom end 65 is directed downwardly toward the driveway 68. The top end 63 has a fourth coupler 71 attached thereto and the free end 46 has a fifth coupler 73 attached thereto. The fourth coupler 71 engages the fifth coupler 73. Each of the fourth 71 and fifth 73 couplers may comprise a hook and loop fastener. The front panel 61 has an entrance aperture 67 extending therethrough. A door 69 is mounted within and entirely covers the entrance aperture 67 and the door 69 is positionable to allow a person to enter through the entrance aperture 67.

The canopy 42 is configured to be retractably extended outwardly from the recoiling member 12. Each of the legs 64 is telescopically extended downwardly into wells 66 in the surface of the driveway 68. Each of the side panels 70 and the front panel 61 may be installed on the canopy 42 after the canopy 42 is extended.

In use, the mount 24 is attached to a dwelling surface 26 above an opening 30, such as a garage door 28, by extending fasteners 40 through the fastener apertures 38 and engaging the dwelling surface 26. The canopy 42 may be extended outwardly from the recoiling member 12 by rotating the spindle 20 in a second direction until the full length of the canopy 42 is extended. Each of the legs 64 may be telescopically extended downwardly into wells 66 in the surface of the driveway 68. Each of the side panels 70 and the front panel 61 may be installed. To retract the canopy 42, each of the side panels 70 and the front panel 61 may be removed. The biasing member 22 may rotate the spindle 20 in the first direction to retract the canopy 42 into the recoiling member 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A retractable canopy assembly configured for temporarily expanding an area of a garage, said assembly comprising:

a recoiling member having a first end, a second end and a cylindrical perimeter wall extending between said first and second ends, said recoiling member being elongated along a longitudinal axis extending from said first end to said second end, said perimeter wall having a canopy aperture extending therethrough, said recoiling member including a spindle rotatably mounted therein and a biasing member biasing a rotation of said spindle in a first direction;

a mount being attached to a top surface of said recoiling member, said mount having a planar upper surface such that said mount is configured to engage a downwardly facing horizontal dwelling surface, said mount including a plate having a front surface and a back surface, said front surface being attached to said perimeter wall, said back surface having a plurality of fastener apertures extending therethrough;

a canopy having an attached end, a free end, a top surface, a bottom surface, a first lateral edge and a second lateral edge, said attached end extending through said canopy aperture and being attached to said recoiling member, said free end being retractably extendable outwardly from said perimeter wall, said recoiling member retracting said canopy into said recoiling member when said spindle rotates in said first direction;

said canopy having a vent aperture extending therethrough;

a net being attached to said top wall and covering said vent aperture, said net comprising a mesh material;

a flap being attached to said top wall and being positionable over said vent aperture and said net;

a coupler being attached to said flap and said canopy for releasably retaining said flap in a closed position extending over said vent aperture;

a pair of legs each being pivotally attached to said canopy adjacent to said free end, each of said legs being telescopic;

a pair of side panels each having a fixable end and a hanging end, each of said first and second lateral edges having one of said fixable ends removably coupled thereto, each of said side panels extending from said free end to said recoiling member, each of said side panels having a viewing aperture positioned therein;

a pair of flexible windows, each of said side panels having one of said flexible windows attached thereto, each of said viewing apertures being covered with one of said flexible windows;

a front panel having a top end and a bottom end, said top end being removably attached to and coextensive with said front end, said front panel having an entrance aperture extending therethrough;

a door being mounted within and entirely covering said entrance aperture, said door being positionable to allow a person to enter through said entrance aperture; and wherein said canopy is configured to be retractably extended outwardly from said recoiling member, whereupon said legs are telescopically extended downwardly into wells in a surface of a driveway.

* * * * *